United States Patent [19]

Cashman

[11] Patent Number: 4,817,506

[45] Date of Patent: Apr. 4, 1989

[54] ROOF VENT

[75] Inventor: John J. Cashman, Royal Oak, Mich.

[73] Assignee: Ridgeline Corporation, Rochester, Mich.

[21] Appl. No.: 157,376

[22] Filed: Feb. 18, 1988

[51] Int. Cl.[4] ..... F24F 7/02

[52] U.S. Cl. ..... 98/42.21; 52/199

[58] Field of Search ..... 52/199; 98/42.2, 42.21

[56] References Cited

U.S. PATENT DOCUMENTS

| | | | |
|---|---|---|---|
| 1,717,728 | 6/1929 | Moore | 98/42.21 |
| 2,799,214 | 7/1957 | Roose | 98/42.21 |
| 3,949,657 | 4/1976 | Sells | 98/42.21 |

FOREIGN PATENT DOCUMENTS

| | | | |
|---|---|---|---|
| 8401970 | 8/1984 | PCT Int'l Appl. | 52/199 |
| 2187222 | 9/1987 | United Kingdom | 52/199 |

*Primary Examiner*—Harold Joyce

*Attorney, Agent, or Firm*—Reising, Ethington, Barnard, Perry & Milton

[57] ABSTRACT

A ventilator (10) for disposition along a roof ridge for venting the internal atmosphere in an enclosure is provided. The ventilator (10) includes a sheet-like cover (12) having a generally inverted V-shaped cross section. A pair of baffles (14) are disposed on the lower surface (18) of the cover (12) and include a plurality of spaced partitions (26) for supporting the baffles (14) rigidly against the cover (12). A post member (42) is disposed between adjacent partitions (26). The baffles (14) include inside (28) and outside (30) edges extending continuously along the lower surface (18) of the cover (12) having female dimples (52) disposed therein matingly shaped to interlock with corrsponding male studs (54) on the lower surface (18) of the cover (12). The inside (28) and outside (30) edges of the baffles (14) are thermally bonded to the lower surface (18) of the cover (12). A plurality of narrow vent slots (60) extend along the baffles (14). Vent slot dividers (62) between each of the vent slots (60) have triangular-shaped cross sections for decreasing resistance to fluid flow thereover.

45 Claims, 5 Drawing Sheets

ROOF VENT

TECHNICAL FIELD

The subject invention relates to a roof ridge ventilator.

BACKGROUND ART

Poor attic ventilation can result in high air conditioning bills in the summer, excessive moisture retention in the winter, loss of insulation efficiency, and destruction of the roof sheathing. To eliminate these undesirable effects, adequate attic ventilation must be provided.

An attic ventilator designed for proper ventilation must effectively utilize the natural forces of temperature and wind. The temperature force, or commonly referred to as the thermal effect, results from a temperature differential between the attic enclosure and that of the outside, coupled with the difference in elevation between the highest and lowest ventilator openings. In order to minimize the thermal effect, a roof ventilator must provide maximum venting capacity, and be disposed at the highest possible elevation.

The force of wind, or commonly referred to as wind pressure, is created when the wind flows over a building, thus creating a vacuum therein. This vacuum produces a negative pressure area on the upwind side of the building and a positive pressure area on the downwind side of the building. Thus, ventilation air moves into the attic through openings in positive pressure areas and exhausts through openings in negative pressure areas. Because the ridge of the roof is always in a negative pressure area, a ventilator disposed on the roof ridge is an exhausting vent. Therefore, in order to minimize the effects of wind pressure, a roof ridge ventilator must provide maximum venting capacity to allow the exhausted attic air to exit therethrough without restriction and must present a low profile for allowing the wind to pass cleanly thereover.

An attic ventilator designed for proper ventilation must also be structurally impervious to foreseeable adverse conditions such as collapse from compressive loading and warpage from summer and winter temperature extremes.

More specifically, it is foreseeable that a person will step on the ventilator during its service life on the roof ridge. If the ventilator collapses under such a compressive loading, its ventilating capacity will be rendered either partially or totally impaired. Therefore, the ventilator must be designed to withstand all foreseeable loading conditions.

Additionally, it is foreseeable that temperature extremes will cause warpage. If the ventilator is fabricated from a thermoplastic material, such as polypropylene, then the possibility of warpage during the temperature extremes of summer will be readily appreciated. More specifically, should the warpage result in the ventilator's air flow passages separating or otherwise enlarging, then an entrance for small animals and the like into the attic is provided. Should the warpage result in the ventilator material softening and consequently creeping, then the air flow passages will contract and thereby diminish the flow capacity. Therefore, the ventilator must be designed to withstand all foreseeable temperature conditions.

Low profile ridge ventilators are known in the prior art. One example of this is shown in the U.S. Pat. No. 2,799,214 to Roose, issued July 16, 1957. The Roose ventilator has a generally inverted V-shaped cross section for conforming to the roof pitch and extends continuously along the roof ridge. An air passage is provided between vent inlet ports and vent outlet ports. The Roose ventilator is deficient in that no support is provided in the air passage between the inlet and outlet ports. That is, the air passage is completely open along the entire length of the ventilator. Accordingly, the vent structure is weak and capable of collapsing upon a sufficient compressive force thereby closing off the vent openings and severely restricting or cutting off the air flow therethrough.

Another example of a low profile roof ridge ventilator is disclosed in the U.S. Pat. No. 4,280,399 to Cunning, issued July 28, 1981. The Cunning ventilator comprises an elongated sheet having longitudinally extending corrugations therealong and vent slots disposed through the side walls of the corrugations. A cap shingle is disposed over the roof ridge ventilator for covering the otherwise exposed roof ridge opening. The Cunning ventilator is deficient in that the cap shingle covering the ventilator provides no support in the trough areas between adjacent corrugations. In other words, a compressive force, such as a person walking on the ventilator, would collapse the cap shingle into the trough portions between adjacent corrugations thereby restricting or cutting off the air flow therethrough. Additionally, the Cunning ventilator requires that the central portion thereof be nailed into a ridge beam extending continuously along the roof ridge. It will be readily appreciated that not every roof structure includes a ridge beam extending therealong.

Another example of a low profile roof ridge ventilator is shown in the U.S. Pat. No. 4,676,147 to Mankowski, issued June 30, 1987. The Mankowski ventilator comprises a one-piece cover member having a hinge extending centrally therealong and including two baffle sections disposed under the cover on opposite sides of the hinge. The baffle sections include a plurality of longitudinally spaced support walls extending approximately one half of the transverse length thereof. That is to say, the support walls do not have peripheries conforming to the entire cross sectional area of the baffle sections, therefore they are not capable of supporting the entire baffle sections under rather heavy compressive loading. A plurality of circular air inlet openings are provided in an inner wall of the baffle sections. The Mankowski ventilator is deficient in that the partitions neither rigidly nor unyieldingly support the baffle sections against the cover member. That is, because the support walls do not extend the entire transverse length of the baffle sections, the ventilator is collapsible in the unsupported areas. Additionally, the baffle sections are not securely fastened to the lower surface of the cover, thereby rendering the ventilator vulnerable to severe warpage during temperature extremes. Further, the design of the air inlet openings can not accommodate foreseeably high exhausted air flow rates while maintaining its low profile characteristics.

SUMMARY OF THE INVENTION AND ADVANTAGES

The subject invention relates to a ventilator of the type for disposition along a roof ridge for venting the internal atmosphere in an enclosure. The ventilator comprises a sheet-like cover means having a cross section extending continuously along the longitudinal axis thereof. The cover means has a lower surface for presentation toward the roof ridge. Baffle means are provided extending along the longitudinal axis on the lower surface of the cover means for allowing the passage of fluid laterally therethrough. The baffle means includes a sheet-like wall member spaced from the lower surface of the cover means a predetermined distance. The wall extends continuously along a longitudinal axis. The ventilator is characterized by the baffle means including support means for rigidly and unyielding supporting the wall in its predetermined spaced distance from the lower surface to prevent collapse and warpage during adverse conditions.

Another aspect of the subject invention provides the baffle means including a floor portion spaced from the lower surface of the cover means and extending generally parallel thereto and continuously along the longitudinal axis. The baffle means also includes a vent portion extending between the floor portion and the lower surface adjacent to the longitudinal axis and extending continuously therealong. The vent portion has air flow apertures therein. The subject invention is characterized by the floor portion including air flow apertures therein.

The subject invention provides a roof ridge ventilator significantly stronger than the prior art ventilators and thereby more resistant to collapse during compressive loading. Additionally, the support means provide improved attachment of the baffle means to the cover means for preventing warpage during temperature extremes. Further, the subject invention provides improved air flow commensurate with foreseeable venting needs.

In this manner, the subject invention properly utilizes the natural forces of the thermal effect and wind pressure by providing maximum air flow potential while simultaneously providing an uncrushable and non-warping baffle design.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

The subject invention relates to a ventilator of the type for disposition along a roof ridge for venting the internal atmosphere in an enclosure.

Figure 1:
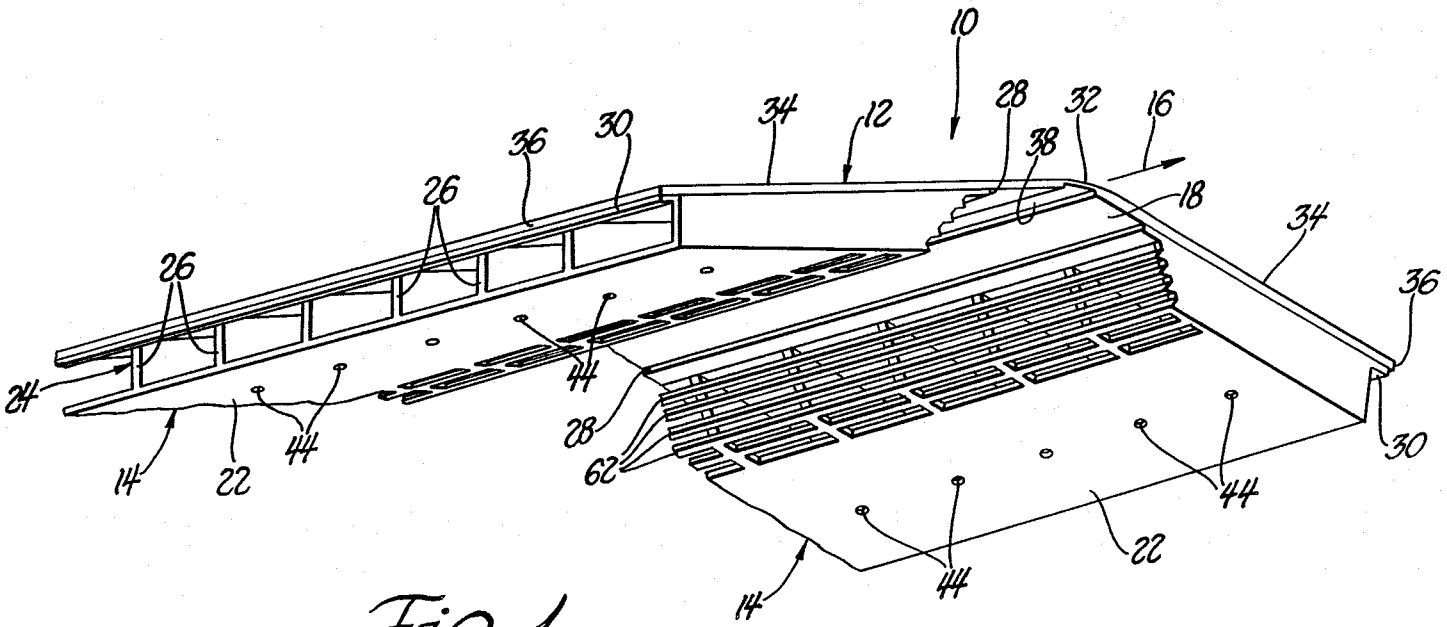
FIG. 1 is a perspective view of the preferred embodiment of the subject invention.

Referring to the figures, wherein like numerals indicate like parts throughout the several views, a ventilator according to the subject invention is generally shown at 10 in FIG. 1. The ventilator 10 comprises a sheet-like cover means, generally indicated at 12, and a baffle means, generally indicated at 14.

The cover means 12 has a cross section extending continuously along a longitudinal axis 16 thereof. The cover means 12 includes a lower surface 18 for presentation toward the roof ridge, and an upper surface 20 opposite the lower surface 18. The upper surface 20 and lower surface 18 are generally smooth, however, the upper surface 20 may be textured to have a grainy appearance.

The baffle means 14 extend along the longitudinal axis 16 of the lower surface 18 of the cover means 12 for allowing the passage of fluid laterally therethrough. That is, the baffle means 14 provide for the passage of air from an opening in the roof ridge to the outside atmosphere. The baffle means 14 include a sheet-like wall member 22 spaced from the lower surface 18 of the cover means 12 a predetermined distance. The wall 22 extends continuously along the longitudinal axis 16 and is situated on the roof ridge.

The subject ventilator 10 is characterized by the baffle means 14 including support means 24 for rigidly and unyieldingly supporting the wall 22 in its predetermined spaced distance from the lower surface 18 to prevent collapse and/or warpage of the wall 22 during adverse conditions. That is to say, the support means 24 preform the dual function of rigidly bracing the wall 22 in its spaced distance from the lower surface 18 to prevent crushing and unyieldingly attaching the baffle means 14 to the cover means 12 to prevent warpage. In this manner, the baffle means 14 is impervious to collapse from any reasonably foreseeable compressive loading. Further, the environmental effects of extreme summer heat and winter cold will not induce separation or warpage between the baffle means 14 and the cover means 12.

The support means 24 includes a plurality of longitudinally spaced parallel partitions 26 extending perpendicularly of the longitudinal axis 16 and having a periphery conforming to the cross sectional shape of the baffle means 14. In other words, the partitions 26 fully conform to the polygonal cross section of the baffle means 14 between the lower surface 18 of the cover means 12 and the wall 22 for rigidly and unyieldingly supporting the wall 22 in its spaced position.

The baffle means 14 includes an inside edge 28 contiguous with the lower surface 18 and disposed adjacent the longitudinal axis 16, and an outside edge 30 contiguous with the lower surface 18 and spaced laterally outwardly of the inside edge 28. The inside edge 28 and the outside edge 30 extend parallel of the longitudinal axis 16 and continuously longitudinally of the longitudinal axis 16, as will be described in detail subsequently.

The cover means 12 has a generally inverted V-shaped cross section including an apex 32 at the longitudinal axis 16 and two generally planar panels 34 symmetrical about the longitudinal axis 16 and extending outwardly and downwardly therefrom. In other words, the apex 32 is coextensive with the longitudinal axis 16. The panels 34 intersect at the apex 32 and extend outwardly therefrom to respective distal edges 36 extending parallel of the longitudinal axis 16.

Figure 5:
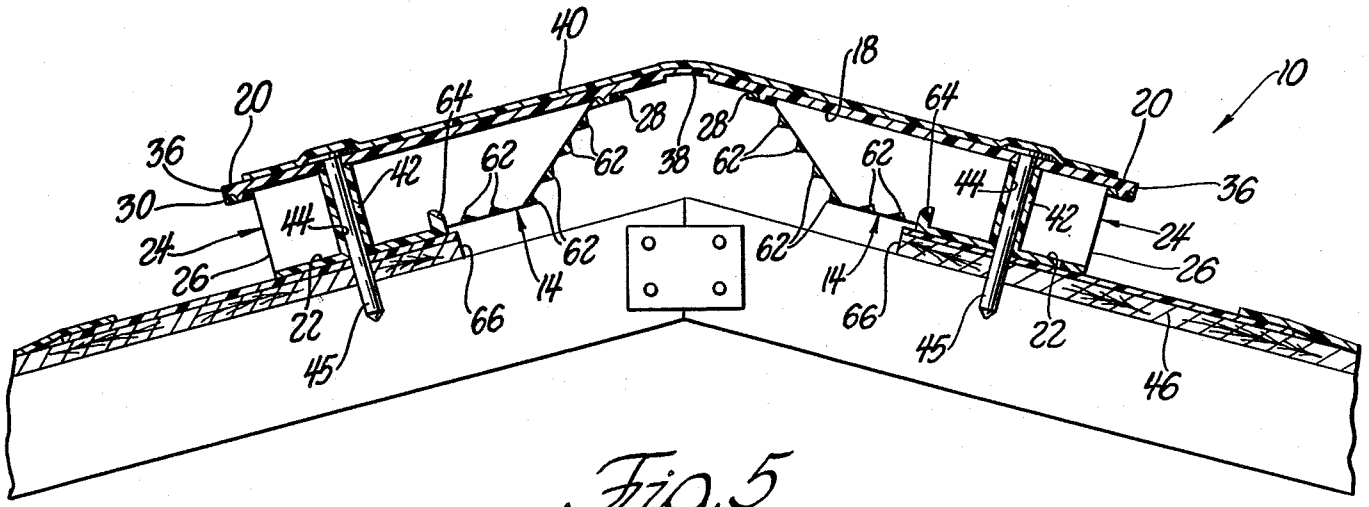
FIG. 5 is a cross-sectional view of the preferred embodiment of the subject invention disposed on a roof ridge.

The cover mans 12 includes a hinge portion 38 extending continuously along the longitudinal axis 16. Preferably, the cover means 12 is a unitary structure, wherein the apex 32 and both panels 34 are an integral unit. The hinge portion 38 comprises a relatively wide rectangular-shaped notch extending the length of the cover means 12. By way of example, a typical cover means 12 may have a width of eleven inches with a corresponding hinge portion width of one inch. The rectangular notch of the hinge portion 38 is disposed in the lower surface 18 of the cover means 12, and has a depth equal to about one half of the thickness of the cover means 12. By way of the previous example, the cover means 12 may have a thickness of 0.075 inches with a corresponding hinge portion depth of 0.045 inches. The use of the wide rectangular-shaped notch results in the apex 32 forming a curvature. This is advantageous in that when a cap shingle 40 is fastened over the ventilator 10, as shown in FIG. 5, it will not split or crack along the apex. Therefore, the subject ventilator 10 will conform to any roof pitch while providing a curved apex 32 to facilitate cap shingle 40 placement thereover.

As shown in FIGS. 1 and 5, the baffle means 14 comprise a pair of baffle means 14 symmetrical about the longitudinal axis 16 on the lower surface 18 of the cover means 12 and adjacent one of the panels 34, respectively. Said another way, two symmetrical baffle means 14 are provided on the lower surface 18 of each panel 34.

Figure 3:
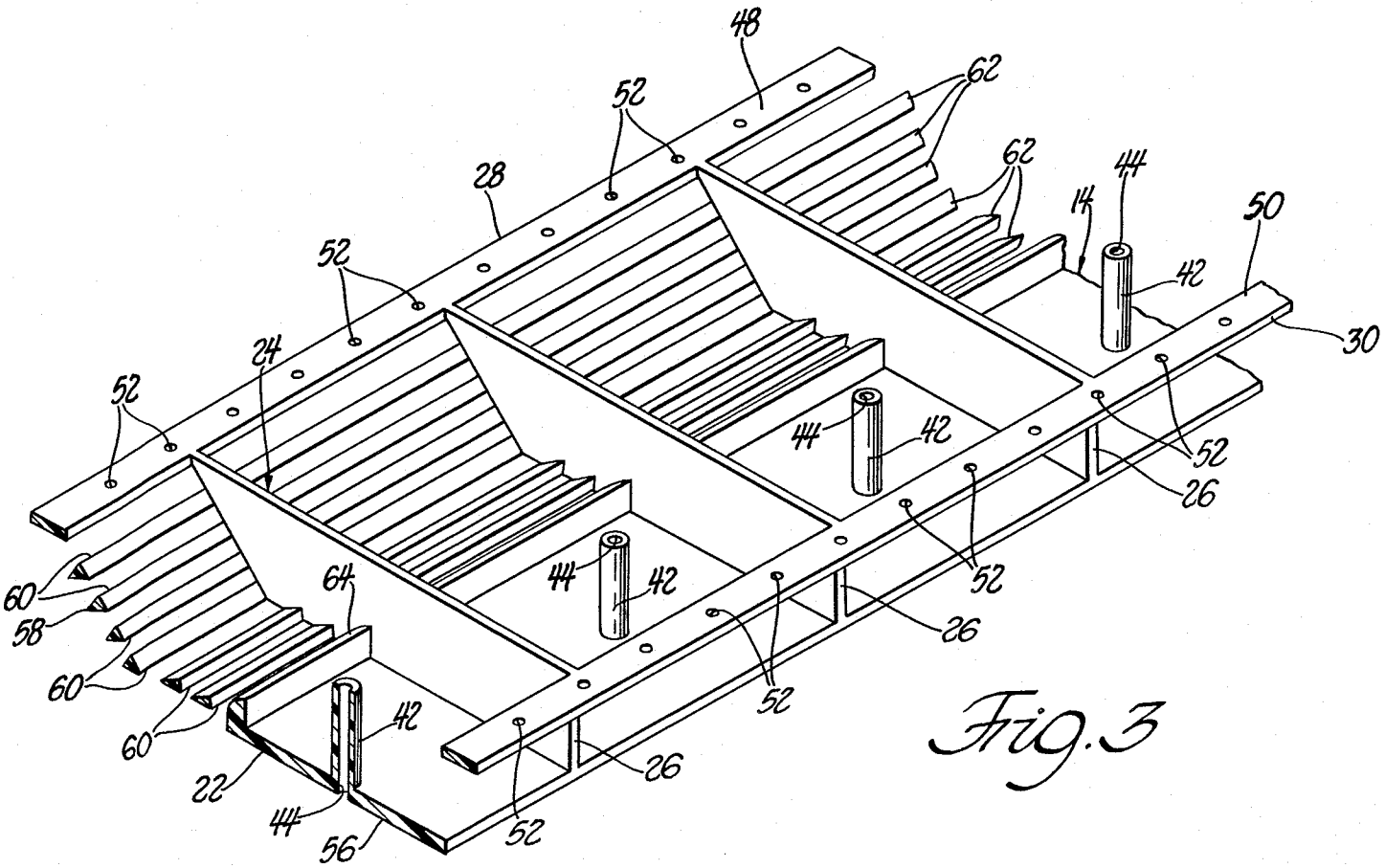
FIG. 3 is a perspective view showing the interior of the baffle means.

As best shown in FIGS. 3 and 5, the support means 14 include at least one post member 42 disposed between adjacent partitions 26 and between the inside edge 28 and the outside edge 30 of each of the baffle means 14. The posts 42 extend perpendicularly from the wall 22 to the lower surface 18 of the cover means 12. As shown in the figures, the posts 42 are cylindrical in shape, however may embody a more frustoconical exterior commensurate with molding limitations peculiar to the material selected and the like.

A nail passage 44 is associated with each post 42. The nail passage 44 extends in an aligned coaxial fashion through the cover means 12, the post 42, and the wall 22. As best shown in FIG. 5, the subject ventilator 10 is secured in a ventilating position to the roof ridge by appropriate nails 45 which may be extended through each nail passage 44 and driven into roofing boards 46. By providing the nail passage 44 through the posts 42, there is no danger of collapsing the cover means 12 into the baffle section 14 upon excessive hammering during installation. Additionally, the nail passages 44 facilitate the installation operation by removing all conjecture on the installer's part as to where the nails 45 should be placed. Further, the nail passages 44 provide additional protection against warpage during temperature extremes as the nails 45 will serve to restrain the cover means 12 from separating from the baffle means 14 while the posts 42 simultaneously prevent the cover means 12 from creeping or sagging into the baffle means 14.

Figure 2:
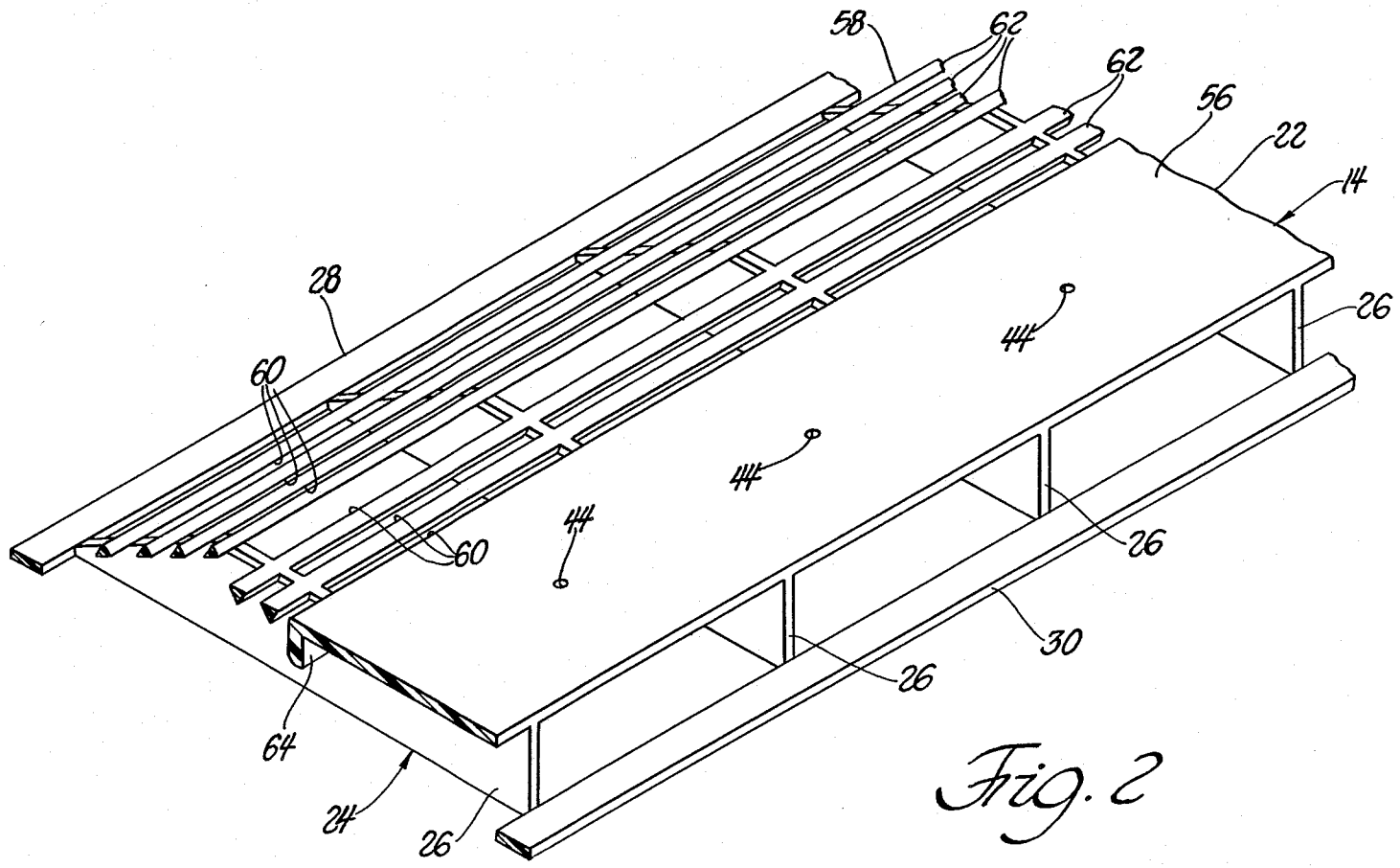
FIG. 2 is a perspective view showing the exterior of the baffle means.

The support means 24 also includes the inside edge 28 and the outside edge 30 being fastened to the cover means 12. That is, the inside edge 28 and the outside edge 30 which extend continuously longitudinally of the longitudinal axis 16 are securely fastened to the lower surface 18 of the cover means 12 to further prevent warpage between the baffle means 14 and the cover means 12. As shown in FIGS. 2 and 3, the inside edge 28 and the outside edge 30 have a flat rectangular cross section including mating faces 48, 50, respectively, contiguous with the lower surface 18 of the cover means 12.

Figure 4:
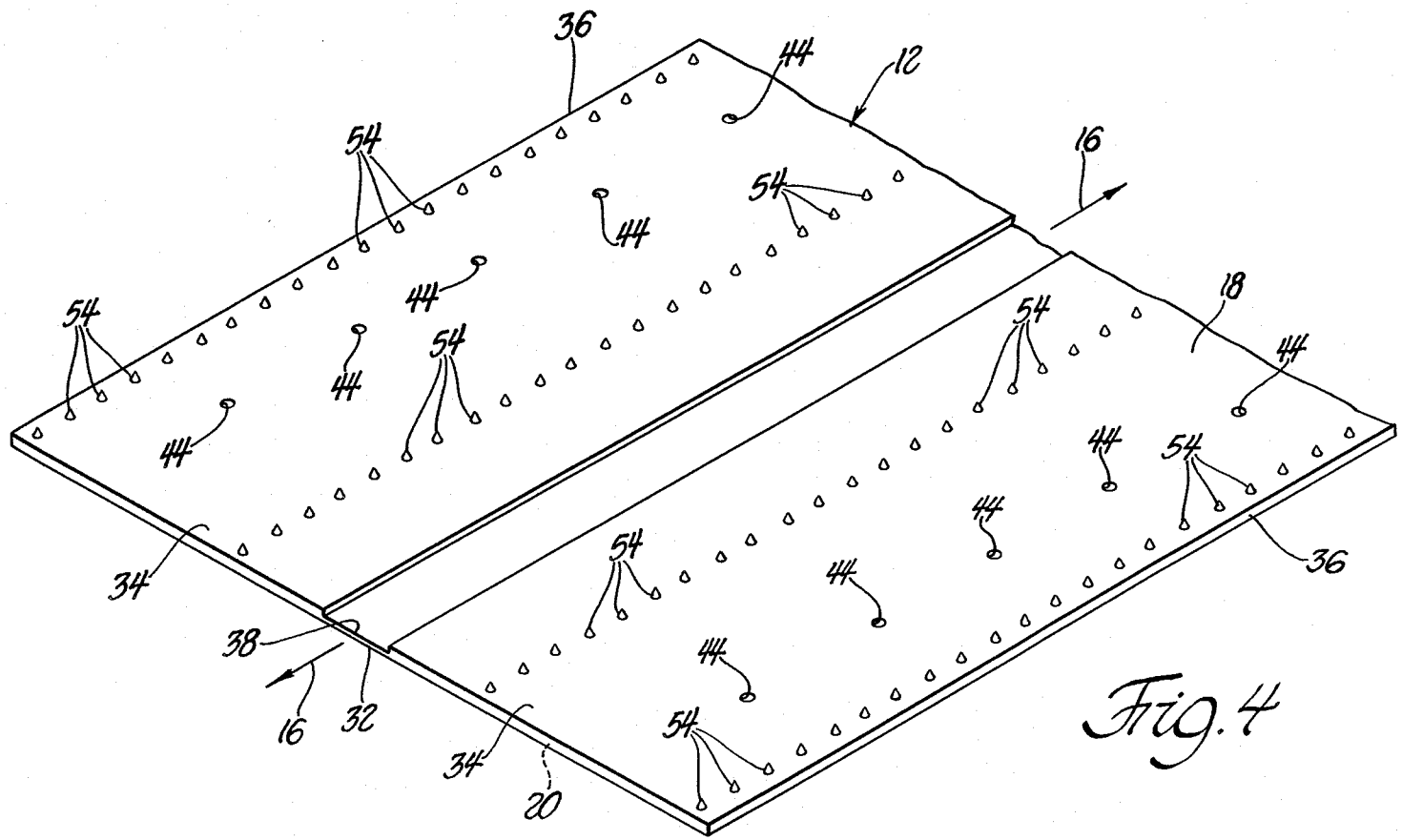
FIG. 4 is a perspective view showing the lower surface of the cover means.

As shown in FIGS. 3, 4 and 5, the mating faces 48, 50 of the inside edge 28 and the outside edge 30 include interlocking locating elements 52 for interlocking with matingly shaped locating elements 54 disposed on the lower surface 18 of the cover means 12. More specifically, the interlocking elements 52, 54 comprise a linear array of male studs 54 extending perpendicularly from the lower surface 18 and corresponding with a linear array of female dimples 52 disposed in each of the mating faces 48, 50 of the inside edge 28 and the outside edge 30. Said another way, two rows of male studs 54 extend longitudinally along the lower surface 18 of each panel 34 and are aligned with matingly shaped female dimples 52 disposed on the mating faces 48, 50 of the inside 28 and outside 30 edges of each baffle means 14. The inside edge 28 and the outside edge 30 are thermally bonded to the lower surface 18 of the cover means 12. Therefore, the interlocking elements 52, 54 provide the dual function of aligning the baffle means 14 on the lower surface 18 of the cover means 12 and also providing additional fastening strength after the thermal bonding operation. Because of the advantages of thermally bonding the baffle means 14 to the cover means 12, it is preferred that the subject ventilator 10 be fabricated from a homogenous plastic material, such as polypropylene.

The wall 22 comprises a floor portion 56 and a vent portion 58. The floor portion 56 is a substantially planar member supported by the support means 24 generally parallel to the cover means 12. The vent portion 58 extends between the floor portion 56 and the inside edge 28. As shown in the figures, the vent portion 58 extends angularly from the floor portion 56 for providing a greater venting area.

The vent portion 58 has air flow apertures 60 disposed therein for allowing the flow of air through the baffle means 14. As described above, a greater cumulative area of the air flow apertures 60 is provided by angling the vent portion 58 between the floor portion 56 and the inside edge 28.

The air flow apertures 60 of the vent portion 58 comprise a plurality of narrow vent slots 60 extending continuously longitudinally of the longitudinal axis 16. That is, the plurality of vent slots 60 are parallel with one another and the longitudinal axis 16. The vent slots 60 of the vent portion 58 are separated by a corresponding plurality of vent slot dividers 62, each having a cross sectional shape for decreasing resistance to fluid flow thereover. In this manner, as the air is exhausted from the attic, through the roof ridge opening and into the baffle means 14, the shape of the vent slot dividers 62 do not impede or otherwise unnecessarily restrict the flow of air therearound. In the preferred embodiment, the vent slot dividers 62 have a triangular-shaped cross section, wherein the knife-edged portion of the triangular cross section projects in the upwind direction.

According to a second characterizing feature of the subject invention, the floor portion 58 includes at least one vent slot 60 disposed therein. Preferably, the vent slot 60 extends continuously longitudinally of the longitudinal axis 16. The vent slot 60 in the floor portion 56 is disposed adjacent the vent portion 58. A corresponding plurality of vent slot dividers 62 separate adjacent vent slots 60 extending along the floor portion 56. The additional vent slots 60 disposed in the floor portion 56 provide additional exhaust air flow passages which result in significantly greater venting capacity.

The floor portion 56 of the wall 22 includes a snow barrier 64 having a generally rectangular cross section, as shown in FIG. 3. The snow barrier 64 extends continuously along the floor portion 56 and extends perpendicularly upwardly therefrom toward the cover means 12. The snow barrier 64 is disposed adjacent the vent portion 58. The vent slots 60 of the floor portion 56 are disposed between the snow barrier 64 and the vent portion 58. The snow barrier 64 has a cross sectional shape for decreasing the resistance of fluid flow thereover. That is, the profile of the snow barrier 64 displays rounded upper edges to facilitate the air flow thereover, while still preserving its functional quality as a barrier to prevent snow, dirt, and the like from entering into the attic through the baffle means 14.

In FIG. 5, a cross section of the subject ventilator 10 is shown affixed over a roof ridge opening defined by two parallel peripheral edges 66 cut from the roof boards 46. During the installation process, the peripheral edges 66 are measured and cut so that the snow barriers 64 of each of the two baffle means 14 are disposed proximately thereof. In this manner, a maximum amount of air flow can be realized through the ventilator 10 by utilizing the vent slots 60 in the floor portion 56. The cap shingle 40 is installed over the cover means 12 using suitable fasteners such as nails or staples.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals ar merely for convenience and are not to be in any way limiting, the invention may be practiced otherwise than as specifically described.

What is claimed is:

1. A ventilator (10) of the type for disposition along a roof ridge for venting the internal atmosphere in the an enclosure, said ventilator (10) comprising: a sheet-like cover means (12) having a cross section extending continuously along a longitudinal axis (16) thereof, said cover means (12) having a lower surface (18) for presentation toward the roof ridge; baffle means (14) having a predetermined cross sectional shape and extending along said longitudinal axis (16) on said lower surface (18) of said cover means (12) for allowing the passage of fluid laterally therethrough, said baffle means (14) including a sheet-like wall member (22) spaced from said lower surface (18) of said cover means (12) a predetermined distance and extending continuously along said longitudinal axis (16); said ventilator (10) characterized by said baffle means (14) including support means (24) for rigidly and unyieldingly supporting said wall (22) in said predetermined spaced distance from said lower surface (18) to prevent collapse and warpage of said wall (22) during adverse conditions, said support means (24) including a plurality of longitudinally spaced parallel partitions (26) extending in a plane perpendicular to said longitudinal axis (16) and said lower surface (18) and said wall (22), each of said partitions (26) having a periphery completely conforming to said cross sectional shape of said baffle means (14).

2. A ventilator (10) as set forth in claim 1 wherein said support means (24) includes an inside edge (28) of said baffle means (14) contiguous with said lower surface (18) adjacent said longitudinal axis (16) and an outside edge (30) of said baffle means (14) contiguous with said lower surface (18) and spaced laterally outwardly of said inside edge (28), further characterized by said inside edge (28) and said outside edge (30) being fastened to said cover means (12).

3. A ventilator (10) as set forth in claim 2 further characterized by said cover means (12) having a generally inverted V-shaped cross section including an apex (32) at said longitudinal axis (16) and two generally planar panels (34) symmetrical about said longitudinal axis (16) and extending outwardly and downwardly therefrom.

4. A ventilator (10) as set forth in claim 3 further characterized by said baffle means (14) comprising a pair of baffle means (14) disposed symmetrically about said longitudinal axis (16) on said lower surface (18) of said cover means (12).

5. A ventilator (10) as set forth in claim 4 further characterized by said cover means (12) including a hinge portion (38) extending continuously along said longitudinal axis (16).

6. A ventilator (10) as set forth in claim 5 further characterized by said cover means (12) being unitary.

7. A ventilator (10) as set forth in claim 6 further characterized by said hinge portion (38) comprising a relatively wide rectangular-shaped notch extending the length of said cover means (12).

8. A ventilator (10) as set forth in claim 5 further characterized by said support means (24) including at least one post member (42) disposed between adjacent said partitions (26) and between said inside edge (28) and said outside edge (30) and extending perpendicularly from said wall (22) to said lower surface (18) of said cover means (12).

9. A ventilator (10) as set forth in claim 8 further characterized by including a nail passage (44) associated with each of said posts (42) and extending in aligned coaxial fashion through said cover means (12), said posts (42) and said wall (22).

10. A ventilator (10) as set forth in claim 8 further characterized by said wall (22) comprising a floor portion (56) generally parallel of said cover means (12) and a vent portion (58) having air flow apertures (60) therein extending between said floor portion (56) and said inside edge (28).

11. A ventilator (10) as set forth in claim 10 further characterized by said air flow apertures (60) of said vent portion (58) comprising a plurality of narrow vent slots (60) extending continuously longitudinally of said longitudinal axis (16).

12. A ventilator (10) as set forth in claim 11 further characterized by said floor portion (56) including at least one vent slot (60) extending continuously longitudinally of said longitudinal axis (16) disposed adjacent said vent portion (58) of said wall (22).

13. A ventilator (10) as set forth in claim 12 further characterized by said vent slots (60) of said vent portion (58) and said floor portion (56) being separated by a corresponding plurality of vent slot dividers (62) each having a cross sectional shape for decreasing resistance to fluid flow thereover.

14. A ventilator (10) as set forth in claim 13 further characterized by said vent slot dividers (62) having a triangular-shaped cross section.

15. A ventilator (10) as set forth in claim 12 further characterized by said floor portion (56) of said wall (22) including a snow barrier (64) having a generally rectangular cross section, said snow barrier (64) extending continuously along said floor portion (56) and perpendicularly therefrom toward said cover means (12) and disposed adjacent said vent portion (58).

16. A ventilator (10) as set forth in claim 15 further characterized by said vent slots (60) of said floor portion (56) being disposed between said snow barrier (64) and said vent portion (58).

17. A ventilator (10) as set forth in claim 16 further characterized by said snow barrier (64) having a cross sectional shape for decreasing the resistance to fluid flow thereover.

18. A ventilator (10) as set forth in either of claims 2 or 17 further characterized by said inside edge (28) and said outside edge (30) extending continuously longitudinally of said longitudinal axis (16).

19. A ventilator (10) as set forth in claim 18 wherein said inside edge (28) and said outside edge (30) include mating faces (48, 50) contiguous with said lower surface (18) of said cover means (12), further characterized by said mating faces (48, 50) of said inside edge (28) and said outside edge (30) including interlocking locating elements (52) for interlocking with matingly shaped locating elements (54) disposed on said lower surface (18) of said cover means (12).

20. A ventilator (10) as set forth in claim 19 further characterized by said support means (24) including said inside edge (28) and said outside edge (30) being thermally bonded to said lower surface (18) of said cover means (12).

21. A ventilator (10) as set forth in claim 20 further characterized by said interlocking elements (52, 54) comprising a linear array of male studs (54) extending perpendicularly from said lower surface (18) and corresponding with a linear array of female dimples (52) disposed in each of said mating faces (48, 50) of said inside edge (28) and said outside edge (30).

22. A ventilator (10) as set forth in claim 21 further characterized by being fabricated from a homogeneous plastic material.

23. A ventilator (10) of the type for disposition along a roof ridge for venting the internal atmosphere in an enclosure, said ventilator (10) comprising: a sheet-like cover means (12) having a cross section extending continuously along a longitudinal axis (16) thereof, said cover means (12) having a lower surface (18) for presentation toward the roof ridge; baffle means (14) extending along said longitudinal axis (16) on said lower surface (18) of said cover means (12) for allowing the passage of fluid laterally therethrough, said baffle means (14) including a floor portion (56) spaced from said lower surface (18) of said cover means (12) and extending generally parallel thereto and continuously along said longitudinal axis (16), a vent portion (58) extending between said floor portion (56) and said lower surface (18) adjacent said longitudinal axis (16) and extending continuously therealong, said vent portion (58) having air flow apertures (60) therein; said ventilator (10) characterized by said floor portion (56) including air flow apertures (60) therein.

24. A ventilator (10) as set forth in claim 23 further characterized by said air flow apertures (60) of said floor portion (56) being disposed adjacent said vent portion (58).

25. A ventilator (10) as set forth in claim 24 further characterized by said air flow apertures (60) of said vent portion (58) and said floor portion (56) comprising a plurality of narrow vent slots (60) extending continuously longitudinally of said longitudinal axis (!6).

26. A ventilator (10) as set forth in claim 25 further characterized by said floor portion (56) including a snow barrier (64) having a generally rectangular cross section, said snow barrier (64) extending continuously along said floor portion (56) and perpendicularly therefrom toward said cover means (12) and disposed adjacent said vent portion (58).

27. A ventilator (10) as set forth in claim 26 further characterized by said snow barrier (64) having a cross sectional shape for decreasing the resistance to fluid flow thereover.

28. A ventilator (10) as set forth in claim 26 further characterized by said vent slots (60) of said floor portion (56) being disposed between said snow barrier (64) and said vent portion (58).

29. A ventilator (10) as set forth in claim 28 further characterized by said vent slots (60) of said vent portion (58) and said floor portion (56) being separated by a corresponding plurality of vent slot dividers (62) each having a cross sectional shape for decreasing resistance to fluid flow thereover.

30. A ventilator (10) as set forth in claim 29 further characterized by said vent slot dividers (62) having a triangular-shaped cross section.

31. A ventilator (10) as set forth in claim 29 wherein said floor portion (56) and said vent portion (58) comprise a sheet-like wall member (22) spaced from said lower surface (18) of said cover means (12) a predetermined distance, further characterized by said baffle means (14) including support means (24) for rigidly and unyieldingly supporting said wall (22) in said predetermined spaced distance from said lower surface (18) to prevent collapse and Warpage of said wall (22) during adverse conditions.

32. A ventilator (10) as set forth in claim 31 further characterized by said support means (24) including a plurality of longitudinally spaced parallel partitions (26) extending perpendicularly of said longitudinal axis (16) and having a periphery conforming to the cross sectional shape of said baffle means (14).

33. A ventilator (10) as set forth in claim 32 wherein said baffle means (14) includes an inside edge (28) contiguous with said lower surface (18) adjacent said longitudinal axis (16) and an outside edge (30) contiguous with said lower surface (18) and spaced laterally outwardly of said inside edge (28), further characterized by said inside edge (28) and said outside edge (30) being fastened to said cover means (12).

34. A ventilator (10) as set forth in claim 33 further characterized by said cover means (12) having a generally inverted V-shaped cross section including an apex (32) at said longitudinal axis (16) and two generally planar panels (34) symmetrical about said longitudinal axis (16) and extending outwardly and downwardly therefrom.

35. A ventilator (10) as set forth in claim 34 further characterized by said baffle means (14) comprising a pair of baffle means (14) symmetrical about said longitudinal axis (16) on said lower surface (18) of said cover means (12) and each adjacent one of said panels (34) respectively.

36. A ventilator (10) as set forth in claim 35 further characterized by said cover means (12) including a hinge portion (38) extending continuously along said longitudinal axis (!6).

37. A ventilator (10) as set forth in claim 36 further characterized by said cover means (12) being unitary.

38. A ventilator (10) as set forth in claim 37 further characterized by said hinge portion (38) comprising a relatively wide rectangular-shaped notch extending the length of said cover means (12).

39. A ventilator (10) as set forth in claim 36 further characterized by said support means (24) including at least one post member (42) disposed between adjacent said partitions (26) and between said inside edge (28) and said outside edge (30) and extending perpendicularly from said wall (22) to said lower surface (18) of said cover means (12).

40. A ventilator (10) as set forth in claim 39 further characterized by including a nail passage (44) associated with each of said posts (42) and extending in aligned coaxial fashion through said cover means (12), said posts (42) and said wall (22).

41. A ventilator (10) as set forth in either of claims 36 or 39 further characterized by said inside edge (28) and said outside edge (30) extending continuously longitudinally of said longitudinal axis (16).

42. A ventilator (10) as set forth in claim 41 wherein said inside edge (28) and said outside edge (30) include mating faces (48, 50) contiguous with said lower surface (18) of said cover means (12), further characterized by said mating faces (48, 50) of said inside edge (28) and said outside edge (30) including interlocking locating elements (52) for interlocking with matingly shaped locating elements (54) disposed on said lower surface (18) of said cover means (12).

43. A ventilator (10) as set forth in claim 42 further characterized by said inside edge (28) and said outside edge (30) being thermally bonded to said lower surface (18) of said cover means (12).

44. A ventilator (10) as set forth in claim 43 further characterized by said interlocking elements (52, 54) comprising a linear array of male studs (54) extending perpendicularly from said lower surface (18) and corresponding with a linear array of female dimples (52) disposed in each of said mating faces (48, 50) of said inside edge (28) and said outside edge (30).

45. 46. A ventilator (10) as set forth in claim 44 further characterized by being fabricated from a homogeneous plastic material.

* * * * *